US009874386B2

(12) United States Patent
Mitchell et al.

(10) Patent No.: US 9,874,386 B2
(45) Date of Patent: Jan. 23, 2018

(54) REFRIGERATOR APPLIANCE

(71) Applicant: General Electric Company, Schenectady, NY (US)

(72) Inventors: Alan Joseph Mitchell, Louisville, KY (US); Ansuraj Seenivasan, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 162 days.

(21) Appl. No.: 14/703,920

(22) Filed: May 5, 2015

(65) Prior Publication Data

US 2016/0327326 A1 Nov. 10, 2016

(51) Int. Cl.

| | |
|---|---|
| ***F25C 5/18*** | (2006.01) |
| ***F25C 1/04*** | (2006.01) |
| ***F25C 5/00*** | (2006.01) |
| ***F25D 23/02*** | (2006.01) |

(52) U.S. Cl.

CPC ..... *F25C 1/04* (2013.01); *F25C 5/005* (2013.01); *F25D 23/025* (2013.01); *F25D 2700/121* (2013.01)

(58) Field of Classification Search

CPC ..... F25C 1/00; F25C 5/005; F25C 2400/10; F25D 23/04

USPC ..... 62/320, 340, 344, 377, 66

See application file for complete search history.

(56) References Cited

U.S. PATENT DOCUMENTS

| | | | | |
|---|---|---|---|---|
| 3,640,088 | A * | 2/1972 | Jacobus | F25C 1/24 219/214 |
| 4,102,660 | A * | 7/1978 | Beckett | F25C 5/005 221/311 |
| 4,227,383 | A * | 10/1980 | Horvay | F25C 5/005 222/351 |
| 7,942,016 | B2 | 5/2011 | Johnson et al. | |
| 8,640,483 | B2 | 2/2014 | Chase et al. | |

FOREIGN PATENT DOCUMENTS

| | | |
|---|---|---|
| WO | WO 2013/045281 A2 | 4/2013 |
| WO | WO 2014/084506 A1 | 5/2014 |

* cited by examiner

*Primary Examiner* — Melvin Jones

(74) *Attorney, Agent, or Firm* — Dority & Manning, P.A.

(57) ABSTRACT

A refrigerator appliance has a dispenser conduit that defines an inner volume. An inlet of the inner volume is positioned adjacent a nugget style ice maker, and an outlet of the inner volume is positioned adjacent a dispenser recess. The dispenser conduit has a projection that extends from an inner surface of the dispenser conduit into the inner volume of the dispenser conduit at the outlet of the inner volume.

15 Claims, 6 Drawing Sheets

REFRIGERATOR APPLIANCE

FIELD OF THE INVENTION

The present subject matter relates generally to refrigerator appliances and ice dispensers for refrigerator appliances.

BACKGROUND OF THE INVENTION

Certain refrigerator appliances include an ice maker. To produce ice, liquid water is directed to the ice maker and frozen. A variety of ice types can be produced depending upon the particular ice maker used. For example, certain ice makers include a mold body for receiving liquid water. An auger within the mold body can rotate and scrape ice off an inner surface of the mold body to form ice nuggets. Such ice makers are generally referred to as nugget style ice makers. Certain consumers prefer nugget style ice makers and their associated ice nuggets.

Dispensing nugget style ice poses certain challenges. For example, nugget style ice is generally stored within a bucket, and a funnel channels the nugget style ice from the bucket to a container within a dispenser recess of an associated refrigerator appliance. Gravity generally urges the nugget style ice through the funnel. However, nugget style ice can swirl within the funnel with a non-vertical velocity component. Thus, as the nugget style ice exits the funnel at the dispenser recess, the nugget style ice can "spray" in an undesirable pattern and miss the container within the dispenser recess.

Accordingly, a refrigerator appliance with features for reducing spray of nugget style ice at a dispenser recess of the refrigerator appliance would be useful.

BRIEF DESCRIPTION OF THE INVENTION

The present subject matter provides a refrigerator appliance with a dispenser conduit that defines an inner volume. An inlet of the inner volume is positioned adjacent a nugget style ice maker, and an outlet of the inner volume is positioned adjacent a dispenser recess. The dispenser conduit has a projection that extends from an inner surface of the dispenser conduit into the inner volume of the dispenser conduit at the outlet of the inner volume. Additional aspects and advantages of the invention will be set forth in part in the following description, or may be apparent from the description, or may be learned through practice of the invention.

In a first exemplary embodiment, a refrigerator appliance is provided. The refrigerator appliance includes a cabinet that defines a chilled chamber and an opening for accessing the chilled chamber of the cabinet. A door is mounted to the cabinet at the opening of the cabinet. The door defines a dispenser recess. The refrigerator appliance also includes a nugget ice maker. A dispenser conduit defines an inner volume. The inner volume of the dispenser conduit is configured for directing ice from the nugget ice maker to the dispenser recess of the door. The inner volume of the dispenser conduit extends between an inlet and an outlet. The inlet of the inner volume is positioned adjacent the nugget ice maker. The outlet of the inner volume is positioned adjacent a top portion of the dispenser recess. The dispenser conduit has a projection that extends from an inner surface of the dispenser conduit into the inner volume of the dispenser conduit at the outlet of the inner volume.

In a second exemplary embodiment, a refrigerator appliance is provided. The refrigerator appliance includes a cabinet that defines a chilled chamber and an opening for accessing the chilled chamber of the cabinet. A door is mounted to the cabinet at the opening of the cabinet. The door defines a dispenser recess. The refrigerator appliance also includes a nugget ice maker. A dispenser conduit defines an inner volume. The inner volume of the dispenser conduit is configured for directing ice from the nugget ice maker to the dispenser recess of the door. The inner volume of the dispenser conduit extends between an inlet and an outlet. The inlet of the inner volume is positioned adjacent the nugget ice maker. The outlet of the inner volume is positioned adjacent a top portion of the dispenser recess. The dispenser conduit has a plurality of projections. Each projection of the plurality of projections extends from an inner surface of the dispenser conduit into the inner volume of the dispenser conduit at the outlet of the inner volume.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
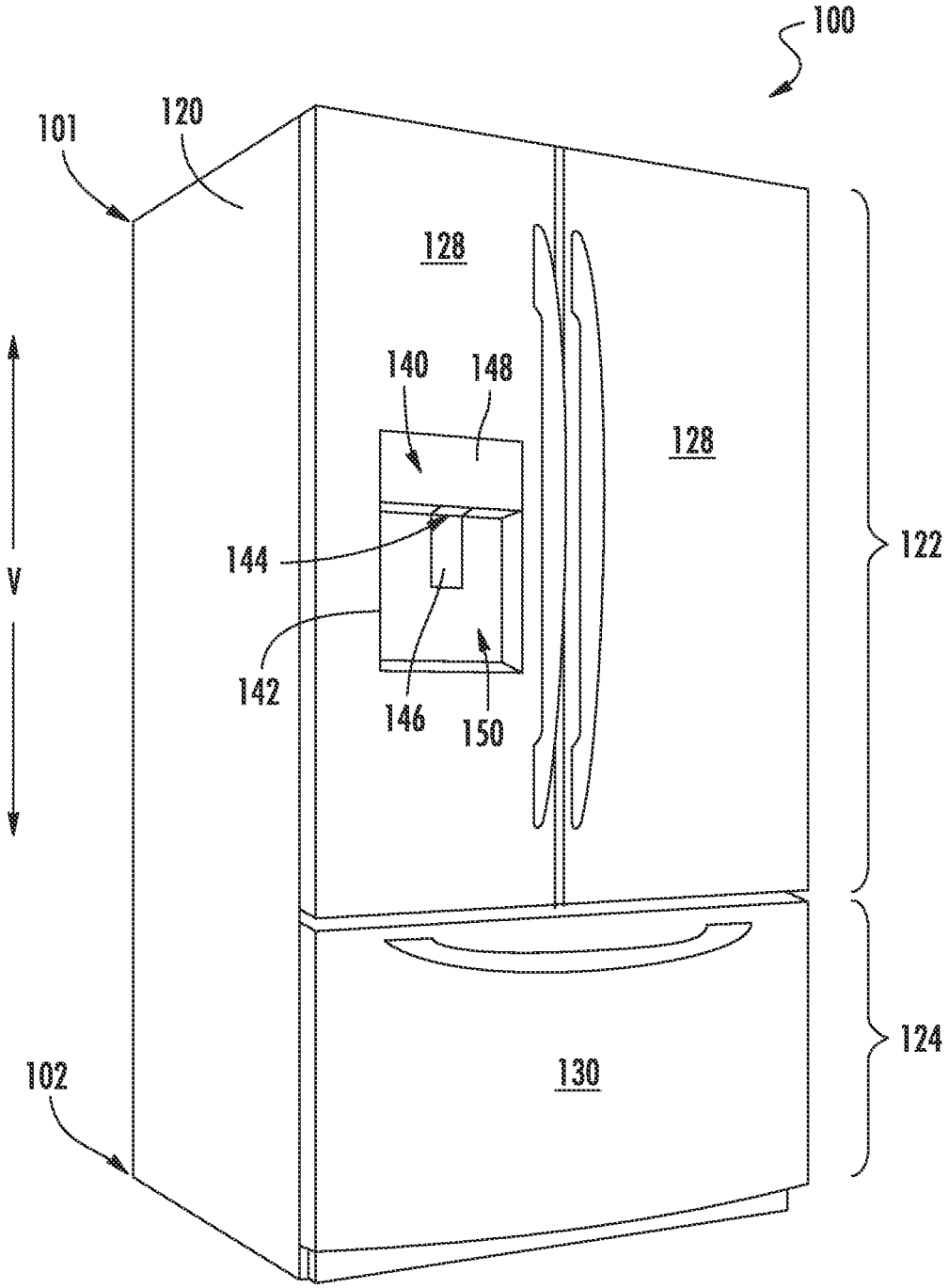
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 120 that extends between a top 101 and a bottom 102 along a vertical direction V. Housing 120 defines chilled chambers for receipt of food items for storage. In particular, housing 120 defines fresh food chamber 122 positioned at or adjacent top 101 of housing 120 and a freezer chamber 124 arranged at or adjacent bottom 102 of housing 120. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 120. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 120. In the exemplary embodiment, dispenser recess 150 is positioned at a level that approximates the chest level of a user.

Figure 2:
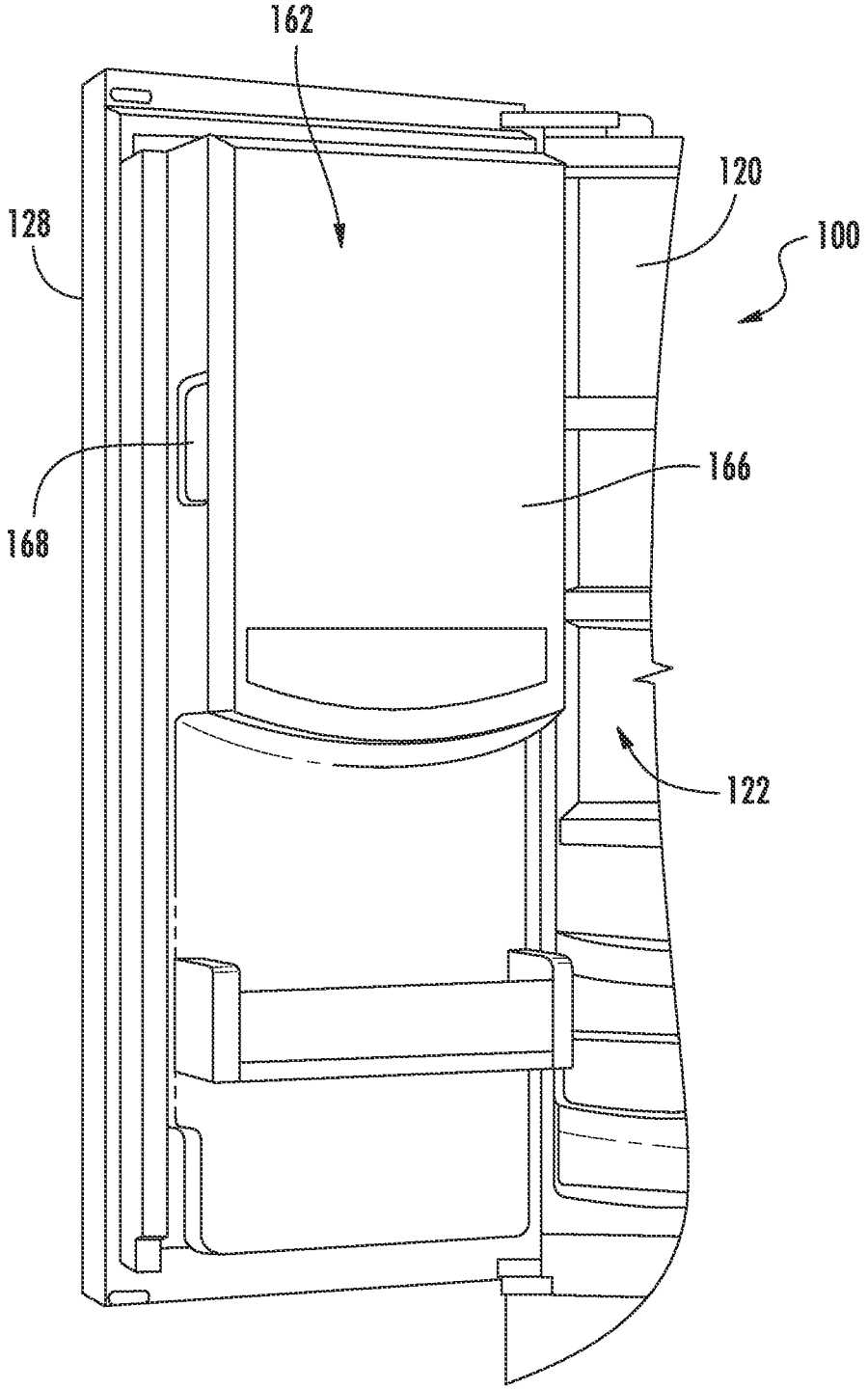
FIG. 2 provides a perspective view of a door of the exemplary refrigerator appliance of FIG. 1.

FIG. 2 provides a perspective view of a door of refrigerator doors 128. Refrigerator appliance 100 includes a sub-compartment 162 defined on refrigerator door 128. Sub-compartment 162 is often referred to as an "icebox." Sub-compartment 162 extends into fresh food chamber 122 when refrigerator door 128 is in the closed position. As discussed in greater detail below, an ice maker or ice making assembly 160 and an ice storage bin 164 (FIG. 3) are positioned or disposed within sub-compartment 162. Thus, ice is supplied to dispenser recess 150 (FIG. 1) from the ice making assembly 160 and/or ice storage bin 164 in sub-compartment 162 on a back side of refrigerator door 128. Chilled air from a sealed system (not shown) of refrigerator appliance 100 may be directed into sub-compartment 162 in order to cool ice making assembly 160 and/or ice storage bin 164. In alternative exemplary embodiments, a temperature air within sub-compartment 162 may correspond to a temperature of air within fresh food chamber 122, such that ice within ice storage bin 164 melts over time.

An access door 166 is hinged to refrigerator door 128. Access door 166 permits selective access to freezer sub-compartment 162. Any manner of suitable latch 168 is configured with freezer sub-compartment 162 to maintain access door 166 in a closed position. As an example, latch 168 may be actuated by a consumer in order to open access door 166 for providing access into freezer sub-compartment 162. Access door 166 can also assist with insulating freezer sub-compartment 162, e.g., by thermally isolating or insulating freezer sub-compartment 162 from fresh food chamber 122.

Figure 3:
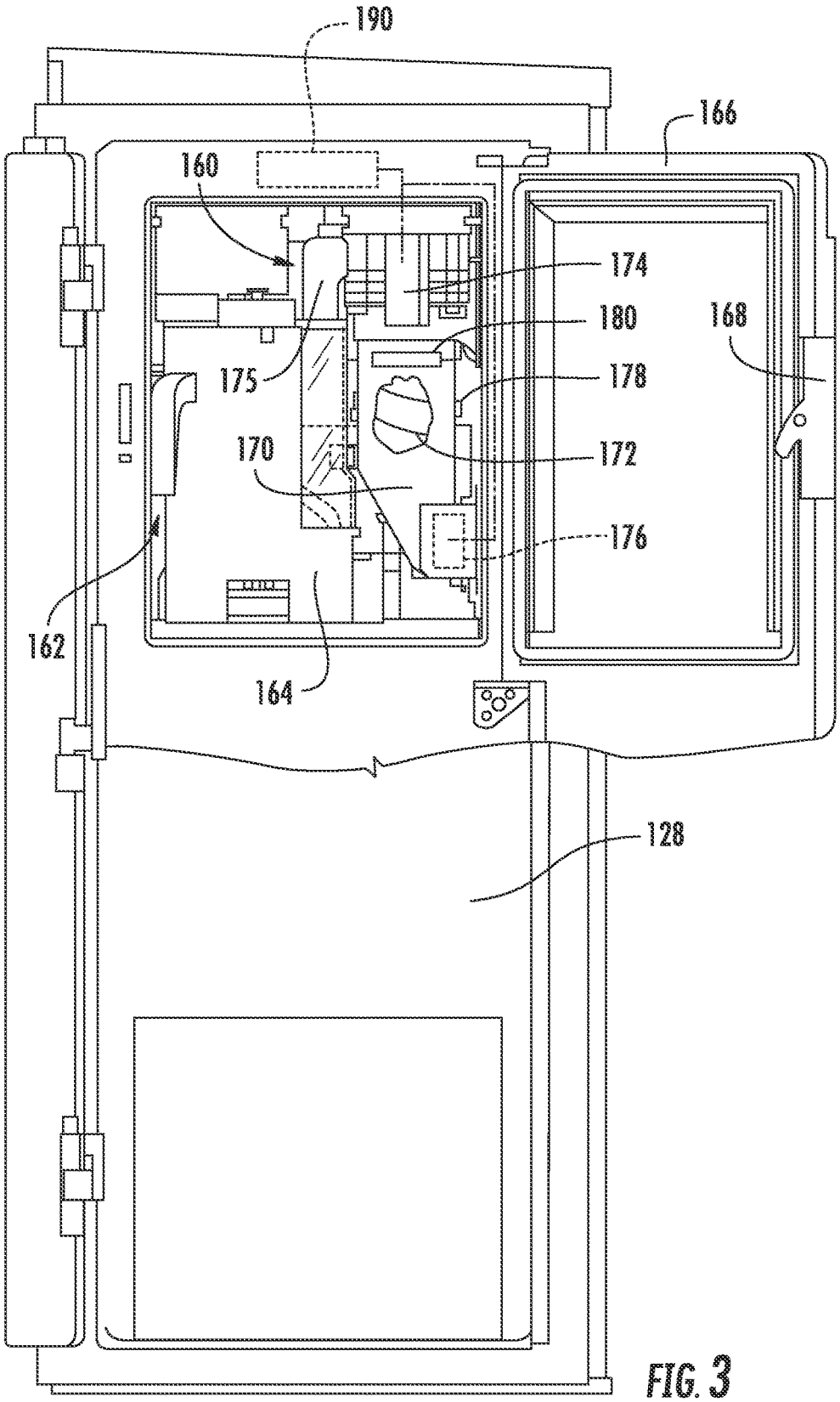
FIG. 3 provides an elevation view of the door of the exemplary refrigerator appliance of FIG. 2 with an access door of the door shown in an open position.

FIG. 3 provides an elevation view of refrigerator door 128 with access door 166 shown in an open position. As may be seen in FIG. 3, ice making assembly 160 is positioned or disposed within freezer sub-compartment 162. Ice making assembly 160 includes a mold body or casing 170. An auger 172 is rotatably mounted in a mold body within casing 170 (shown partially cutout to reveal auger 172). In particular, a motor 174 is mounted to casing 170 and is in mechanical communication with (e.g., coupled to) auger 172. Motor 174 is configured for selectively rotating auger 172 in the mold body within casing 170. During rotation of auger 172 within the mold body, auger 172 scrapes or removes ice off an inner surface of the mold body within casing 170 and directs such ice to an extruder 175. At extruder 175, ice nuggets are formed from ice within casing 170. An ice bucket or ice storage bin 164 is positioned below extruder 175 and receives the ice nuggets from extruder 175. From ice storage bin 164, the ice nuggets can enter dispensing assembly 140 and be accessed by a user as discussed above. In such a manner, ice making assembly 160 can produce or generate ice nuggets.

Ice making assembly 160 also includes a fan 176. Fan 176 is configured for directing a flow of chilled air towards casing 170. As an example, fan 176 can direct chilled air from an evaporator of a sealed system through a duct to casing 170. Thus, casing 170 can be cooled with chilled air from fan 176 such that ice making assembly 160 is air cooled in order to form ice therein. Ice making assembly 160 also includes a heater 180, such as an electric resistance heating element, mounted to casing 170. Heater 180 is configured for selectively heating casing 170, e.g., when ice prevents or hinders rotation of auger 172 within casing 170.

Operation of ice making assembly 160 is controlled by a processing device or controller 190, e.g., that may be operatively coupled to control panel 148 for user manipulation to select features and operations of ice making assembly 160. Controller 190 can operates various components of ice making assembly 160 to execute selected system cycles and features. For example, controller 190 is in operative communication with motor 174, fan 176 and heater 180. Thus, controller 190 can selectively activate and operate motor 174, fan 176 and heater 180.

Controller 190 may include a memory and microprocessor, such as a general or special purpose microprocessor operable to execute programming instructions or micro-control code associated with operation of ice making assembly 160. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Motor 174, fan 176 and heater 180 may be in communication with controller 190 via one or more signal lines or shared communication busses.

Ice making assembly 160 also includes a temperature sensor 178. Temperature sensor 178 is configured for measuring a temperature of casing 170 and/or liquids, such as liquid water, within casing 170. Temperature sensor 178 can be any suitable device for measuring the temperature of casing 170 and/or liquids therein. For example, temperature sensor 178 may be a thermistor or a thermocouple. Controller 190 can receive a signal, such as a voltage or a current, from temperature sensor 190 that corresponds to the temperature of the temperature of casing 170 and/or liquids therein. In such a manner, the temperature of casing 170 and/or liquids therein can be monitored and/or recorded with controller 190.

Figure 4:
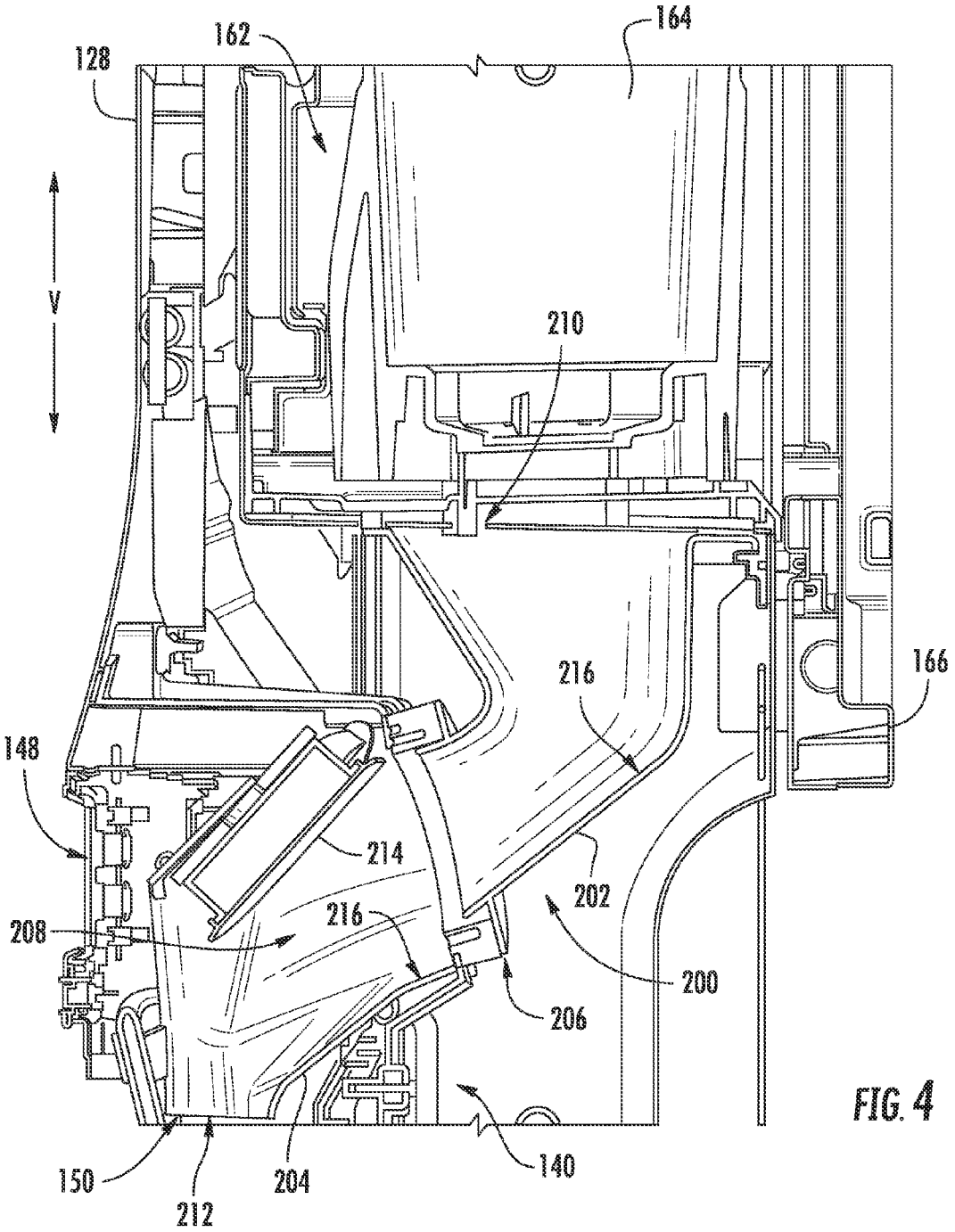
FIG. 4 provides a section view of a dispenser assembly of the exemplary refrigerator appliance of FIG. 1.

FIG. 4 provides a section view of dispensing assembly 140 of refrigerator appliance 100. As may be seen in FIG. 4, dispensing assembly 140 includes a dispenser conduit 200 positioned at least partially within one of refrigerator doors 128. Dispenser conduit 200 includes a top piece or portion 202 and a bottom piece or portion 204 that are connected or joined together at joint 206. It should be understood that dispenser conduit 200 shown in FIG. 2 is provided by way of example only and that, in alternative exemplary embodiments, dispenser conduit 200 may be formed as a single piece or as more than two pieces, e.g., three, four or more pieces.

Dispenser conduit 200 defines an inner volume 208. Inner volume 208 of dispenser conduit 200 is configured for directing ice from ice making assembly 160 to dispenser recess 150. In particular, inner volume 208 of dispenser conduit 200 extends between an inlet 210 and an outlet 212. Inlet 210 of inner volume 208 is positioned at or adjacent ice making assembly 200, and outlet 212 of inner volume 208 is positioned at or adjacent a top portion of dispenser recess 150, e.g., and forms or corresponds to discharging outlet 144 (FIG. 1). Inlet 210 of inner volume 208 may be positioned above outlet 212 of inner volume 208 along the vertical direction V, e.g., such that gravity urges ice nuggets from ice storage bin 164 into and through inner volume 208 of dispenser conduit 200 to outlet 212 of inner volume 208. Inlet 210 of inner volume 208 may also be offset from outlet 212 of inner volume 208 along a direction that is perpendicular to the vertical direction V, e.g., such that inlet 210 of inner volume 208 is unaligned with outlet 212 of inner volume 208 along the vertical direction V, as shown in FIG. 4. Inlet 210 of inner volume 208 may also have a larger cross-sectional area (e.g., in a plane that is perpendicular to the vertical direction V) than outlet 212 of inner volume 208. Thus, dispenser conduit 200 may funnel ice nuggets through inner volume 208 of dispenser conduit 200 from inlet 210 of inner volume 208 to outlet 212 of inner volume 208. Outlet 212 of inner volume 208 may also have a circular shape, e.g., in a plane that is perpendicular to the vertical direction V, in certain exemplary embodiments.

A duct door 214 is positioned within dispenser conduit 200, e.g., at or adjacent the joint 206 between top portion 202 and bottom portion 204 of dispenser conduit 200. Duct door 214 is selectively adjustable (e.g., rotatable) between an open position (shown in FIG. 4) and a closed position. In the closed position, duct door 214 is positioned between dispenser recess 150 and freezer sub-compartment 162. Thus, duct door 214 may block or hinder air flow between dispenser recess 150 and freezer sub-compartment 162 and reduce heat transfer between dispenser recess 150 and freezer sub-compartment 162. Conversely, in the open position, duct door 214 is not positioned between dispenser recess 150 and freezer sub-compartment 162. Thus, nugget ice from ice making assembly 160 may flow through inner volume 208 to outlet 212 of inner volume 208 without impacting duct door 214. Duct door 214 may normally be in the closed position and may shift to the open position when a user operates actuating mechanism 146. Dispenser conduit 214 may be sized and shaped, e.g., with a recess 217, for permitting movement or rotation of duct door 214 between the open and closed positions within dispenser conduit 214.

Figure 5:
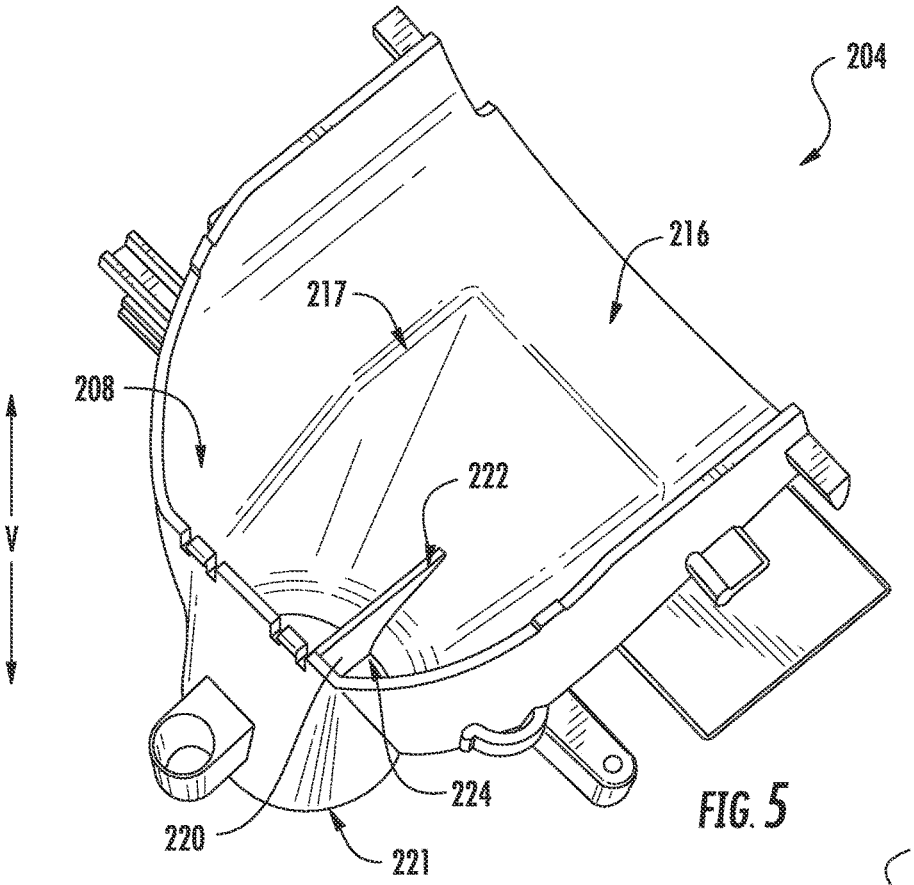
FIG. 5 provides a perspective view of a bottom portion of a dispenser conduit of the dispenser assembly of FIG. 4.
Figure 6:
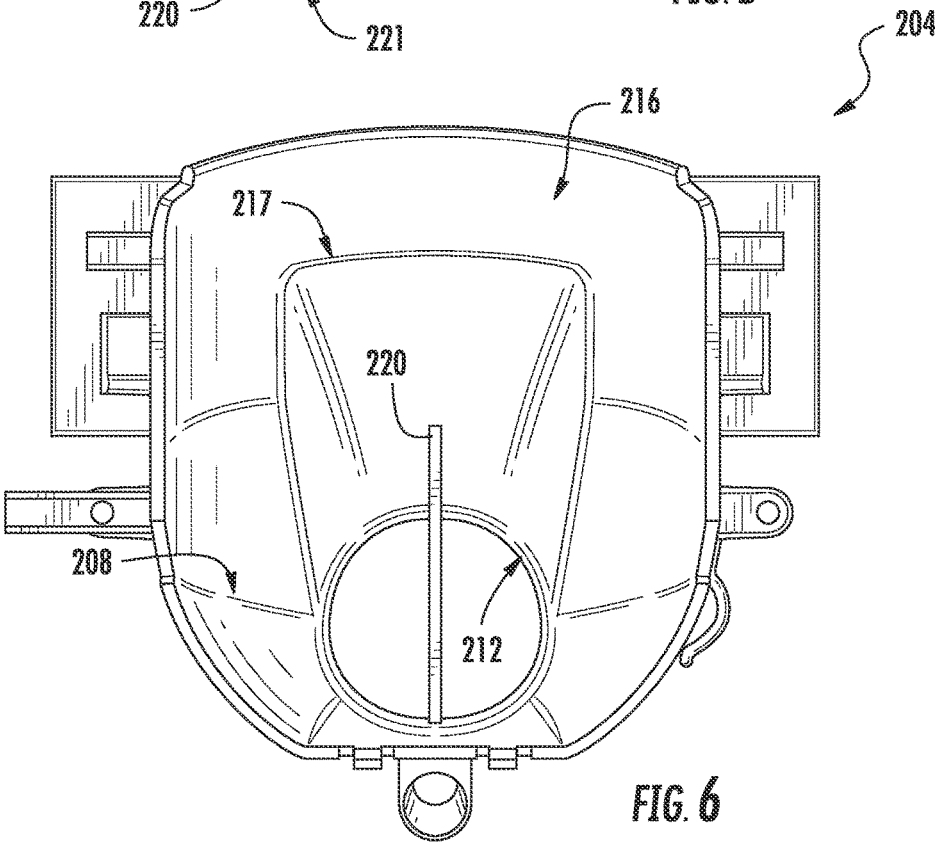
FIG. 6 provides a top, plan view of the bottom portion of the dispenser conduit of FIG. 5.

FIG. 5 provides a perspective view of bottom portion 204 of dispenser conduit 200. FIG. 6 provides a top, plan view of bottom portion 204 of dispenser conduit 200. As may be seen in FIGS. 5 and 6, dispenser conduit 200 includes a projection 220. Projection 220 extends from an inner surface 216 of dispenser conduit 200, e.g., that faces and/or defines inner volume 208 of dispenser conduit 200. In particular, projection 220 extends from inner surface 216 of dispenser conduit 200 into inner volume 208 of dispenser conduit 200 at or adjacent outlet 212 of inner volume 208. As shown in FIGS. 5 and 6, projection 220 may extend across inner volume 208 of dispenser conduit 200 at outlet 212 of inner volume 208, in certain exemplary embodiments.

Projection 220 may be formed or mounted on inner surface 216 of dispenser conduit 200 using any suitable mechanism or in any suitable manner. For example, projection 220 may be integrally formed on inner surface 216 of dispenser conduit 220. Thus, projection 220 and inner surface 216 of dispenser conduit 200 may be formed of or with a single, continuous piece of material, such as a suitable plastic. In certain exemplary embodiments, dispenser conduit 200 may be integrally formed of injection molded plastic. In alternative exemplary embodiments, projection 220 may be fastened, adhered, snap-fit, etc. on inner surface 216 of dispenser conduit 200.

Projection 220 also extends upwardly, e.g., along the vertical direction V, on inner surface 216 of dispenser conduit 200 from outlet 212 of inner volume 208. For example, as may be seen in FIG. 5, projection 220 extends between an upper portion 222 and a lower portion 224, e.g., along the vertical direction V. Lower portion 224 of projection 220 is positioned at or adjacent outlet 212 of inner volume 208, and upper portion 222 of projection 220 is positioned within inner volume 208 of dispenser conduit 200 above lower portion 224 of projection 220. Thus, projection 220 may extend vertically upwardly from outlet 212 of inner volume 208 within inner volume 208 of dispenser conduit 200.

Projection 220 is positioned and oriented for obstructing non-vertical motion of ice exiting dispenser conduit 200 at outlet 212 of inner volume 208. For example, nugget ice from ice making assembly 160 may swirl on inner surface 216 of dispenser conduit 200, e.g., while sliding on inner surface 216 of dispenser conduit 200. In particular, nugget ice from ice making assembly 160 may develop a non-vertical velocity component (e.g., a velocity component in a plane that is perpendicular to the vertical direction V) while flowing through inner volume 208 of dispenser conduit 200 to outlet 212 of inner volume 208. However, projection 220 may be positioned and oriented such that the nugget ice flowing through inner volume 208 of dispenser conduit 200 strikes or impacts projection 220 prior to exiting inner volume 208 of dispenser conduit 200 at outlet 212 of inner volume 208. When the nugget ice strikes or impacts projection 220, any non-vertical velocity of the nugget ice is reduced or limited, and nugget ice exiting dispenser conduit 200 may fall downwardly along the vertical direction V into a container within dispenser recess 150. In such a manner, nugget ice "spray" from dispenser conduit 200 may be reduced, and nugget ice exiting dispenser conduit 200 may flow in a more controlled or regulated manner into an associated container within dispenser recess 150.

Figure 7:
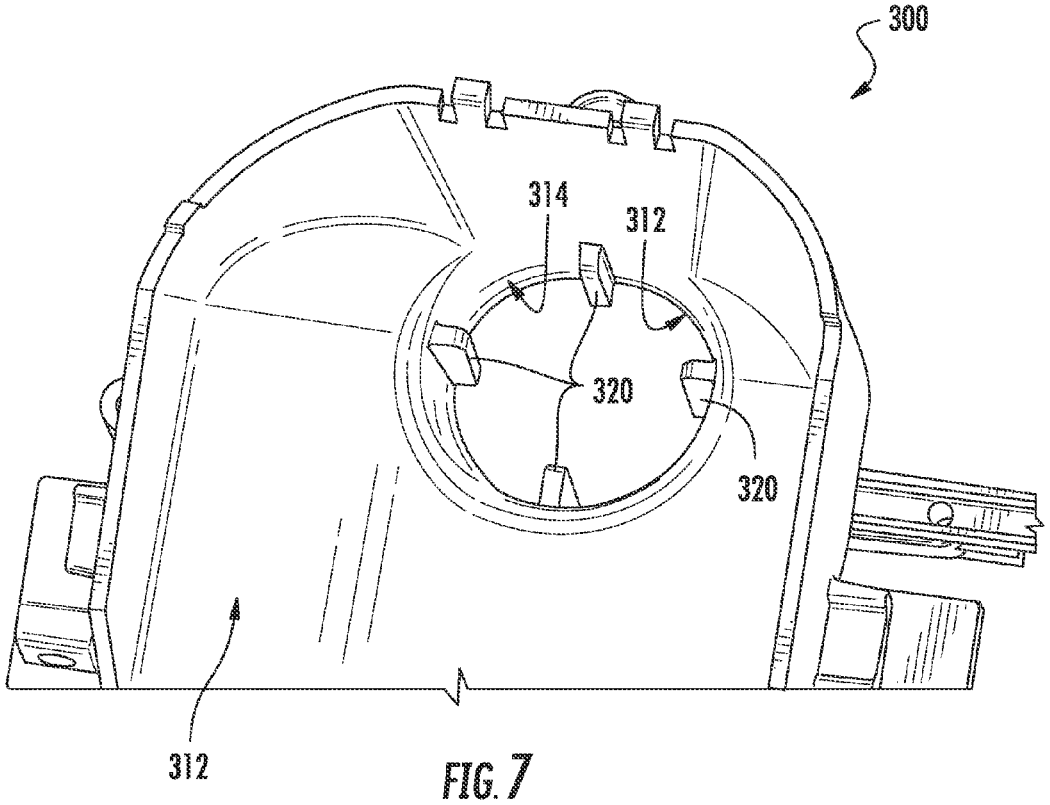
FIG. 7 provides a partial, perspective view of a bottom portion of a dispenser conduit according to another exemplary embodiment of the present subject matter.

FIG. 7 provides a partial, perspective view of a bottom portion 300 of dispenser conduit 200 according to another exemplary embodiment of the present subject matter. Bottom portion 300 of dispenser conduit 200 is constructed in the similar manner to bottom portion 204 of dispenser conduit 200 (FIG. 3) and includes similar components. For example, bottom portion 300 of dispenser conduit 200 defines or includes an inner volume 310, an outlet 312 and an inner surface 314. Bottom portion 300 of dispenser conduit 200 may be used in lieu of bottom portion 204 of dispenser conduit 200. Various features of bottom portion 300 of dispenser conduit 200 may also be incorporated into bottom portion 204 of dispenser conduit 200, in alternative exemplary embodiments.

As shown in FIG. 7, bottom portion 300 of dispenser conduit 200 includes a plurality of projections 320. Each projection of projections 320 extends from inner surface 314 of bottom portion 300 into inner volume 310 of bottom portion 300. Projections 320 are also positioned at or adjacent outlet 312 of inner volume 310.

Projections 320 may include any suitable number of projections 320. For example, projections 320 may include two, three, four, five or more projections. In certain exemplary embodiments, projections 320 include at least four projections. Projections 320 may also be distributed in any suitable manner on inner surface 314 of bottom portion 300. For example, projections 320 may be uniformly distributed (e.g., in a plane that is perpendicular to the vertical direction V) on inner surface 314 of bottom portion 300. Thus, as shown in FIG. 7, each projection of projections 320 may be spaced apart from adjacent projections of projections 320 by about ninety degrees on inner surface 314 of bottom portion 300, e.g., in a plane that is perpendicular to the vertical direction V. At least one of projections 320 may extend across inner volume 310 of bottom portion 300, e.g., as shown FIG. 5, in alternative exemplary embodiments.

Like projection 220 (FIG. 5), projections 320 are positioned and oriented for obstructing non-vertical motion of ice exiting dispenser conduit 200 at outlet 312 of inner volume 310. In particular, projections 320 may be positioned and oriented such that the nugget ice flowing through inner volume 310 of bottom portion 300 strikes or impacts at least one of projections 320 prior to exiting inner volume 310 of bottom portion 300 at outlet 312 of bottom portion 300. When the nugget ice strikes or impacts projections 320, any non-vertical velocity of the nugget ice is reduced or limited, and nugget ice exiting dispenser conduit 200 may fall downwardly along the vertical direction V into a container within dispenser recess 150. In such a manner, nugget ice "spray" from dispenser conduit 200 may be reduced, and nugget ice exiting dispenser conduit 200 may flow in a more controlled or regulated manner into an associated container within dispenser recess 150.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a chilled chamber and an opening for accessing the chilled chamber of the cabinet;

a door mounted to the cabinet at the opening of the cabinet, the door defining a dispenser recess;

a nugget ice maker; and a dispenser conduit defining an inner volume, the inner volume of the dispenser conduit configured for directing ice from the nugget ice maker to the dispenser recess of the door, the inner volume of the dispenser conduit extending between an inlet and an external discharging outlet, the inlet of the inner volume positioned adjacent the nugget ice maker, the external discharging outlet of the inner volume mounted in the dispenser recess adjacent a top portion of the dispenser recess, the dispenser conduit having a projection that extends from an inner surface of the dispenser conduit into the inner volume of the dispenser conduit at the external discharging outlet of the inner volume, wherein the projection and the inner surface are integrally formed of a single, continuous piece of material.

2. The refrigerator appliance of claim 1, wherein the projection extends across the inner volume of the dispenser conduit at the outlet of the inner volume.

3. The refrigerator appliance of claim 1, wherein the dispenser conduit further comprises at least one additional projection, each projection of the at least one additional projection integrally formed of the single, continuous piece of material and extending from the inner surface of the dispenser conduit into the inner volume of the dispenser conduit at the external discharging outlet of the inner volume.

4. The refrigerator appliance of claim 3, wherein the at least one additional projection comprises three additional projections.

5. The refrigerator appliance of claim 3, wherein the projection and each projection of the at least one additional projection are uniformly distributed on the inner surface of the dispenser conduit at the external discharging outlet of the inner volume.

6. The refrigerator appliance of claim 3, wherein the projection and each projection of the at least one additional projection extend vertically upward on the inner surface of the dispenser conduit from the external discharging outlet of the inner volume.

7. The refrigerator appliance of claim 1, wherein the projection is positioned and oriented for obstructing non-vertical motion of ice sliding on the inner surface of the dispenser conduit.

8. The refrigerator appliance of claim 1, wherein the single, continuous piece of material comprises molded plastic.

9. A refrigerator appliance, comprising:

a cabinet defining a chilled chamber and an opening for accessing the chilled chamber of the cabinet;

a door mounted to the cabinet at the opening of the cabinet, the door defining a dispenser recess;

a nugget ice maker; and a dispenser conduit defining an inner volume, the inner volume of the dispenser conduit configured for directing ice from the nugget ice maker to the dispenser recess of the door, the inner volume of the dispenser conduit extending between an inlet and an external discharging outlet, the inlet of the inner volume positioned adjacent the nugget ice maker, the external discharging outlet of the inner volume mounted in the dispenser recess adjacent a top portion of the dispenser recess, the dispenser conduit having a plurality of projections, each projection of the plurality of projections extending from an inner surface of the dispenser conduit into the inner volume of the dispenser conduit at the external discharging outlet of the inner volume wherein the plurality of projections and the inner surface are integrally formed of a single, continuous piece of material.

10. The refrigerator appliance of claim 9, wherein at least one of the projections of the plurality of projections extends across the inner volume of the dispenser conduit at the outlet of the inner volume.

11. The refrigerator appliance of claim 9, wherein the plurality of projections comprises at least four projections.

12. The refrigerator appliance of claim 9, wherein the projections of the plurality of projections are uniformly distributed on the inner surface of the dispenser conduit at the external discharging outlet of the inner volume.

13. The refrigerator appliance of claim 9, wherein each projection of the plurality of projections extends vertically upward on the inner surface of the dispenser conduit from the external discharging outlet of the inner volume.

14. The refrigerator appliance of claim 1, wherein the projections of the plurality of projections are positioned and oriented for obstructing non-vertical motion of ice sliding on the inner surface of the dispenser conduit.

15. The refrigerator appliance of claim 9, wherein the single, continuous piece of material comprises molded plastic.

* * * * *